US005535644A

United States Patent [19]

Paul-Alexandre et al.

[11] Patent Number: 5,535,644

[45] Date of Patent: Jul. 16, 1996

[54] OPENER FOR REMOVING A CONTAINER CAP

[76] Inventors: Raoul Paul-Alexandre, 156A Defrack Dr., Lake Hiawatha, N.J. 07034; Anthony Cifelli, 150 Pine Brook Rd., Montville, N.J. 07045

[21] Appl. No.: 452,723

[22] Filed: May 30, 1995

[51] Int. Cl.[6] ..... B67B 7/04

[52] U.S. Cl. ..... 81/3.09; 81/3.45; 81/3.55; 81/177.4

[58] Field of Search ..... 81/3.09, 3.29, 81/3.35, 3.36, 3.45, 3.55, 3.47, 3.57, 3.48, 490, 177.4

[56] References Cited

U.S. PATENT DOCUMENTS

| | | | |
|---|---|---|---|
| 71,316 | 11/1867 | McCoun . | |
| 1,218,757 | 3/1917 | Gessler . | |
| 1,670,199 | 5/1928 | La Schum . | |
| 1,695,098 | 12/1928 | Hiering . | |
| 2,164,191 | 6/1939 | Knudsen | 65/46 |
| 2,714,409 | 8/1955 | Primrose et al. | 145/62 |
| 2,886,994 | 5/1959 | Hanson | 81/3.35 |
| 3,902,226 | 9/1975 | Messenbaugh | 81/3.55 X |
| 4,949,600 | 8/1990 | Tricinella | 81/3.09 |
| 5,169,305 | 12/1992 | Kee | 81/3.57 X |
| 5,285,543 | 2/1994 | Rowe | 7/138 |

FOREIGN PATENT DOCUMENTS

| | | | |
|---|---|---|---|
| 2785 | 3/1903 | United Kingdom | 81/3.45 |
| 2091227 | 7/1982 | United Kingdom | B67B 7/04 |

*Primary Examiner*—D. S. Meislin
*Attorney, Agent, or Firm*—Thomas L. Adams

[57] ABSTRACT

An opener can remove a container cap with a discrete, rigid tab mounted in a notch formed in a handle. The notch is formed in a first end of the handle and extends transversely across the handle for engaging the container cap. The tab is mounted at one of a pair of banks bordering the notch. The tab extends partially into the notch for engaging the container cap. The handle can have a centrally located transverse bore adapted to hold a corkscrew coaxially. For a hollow handle, the corkscrew can be stored inside the handle.

17 Claims, 2 Drawing Sheets

FIG. 3
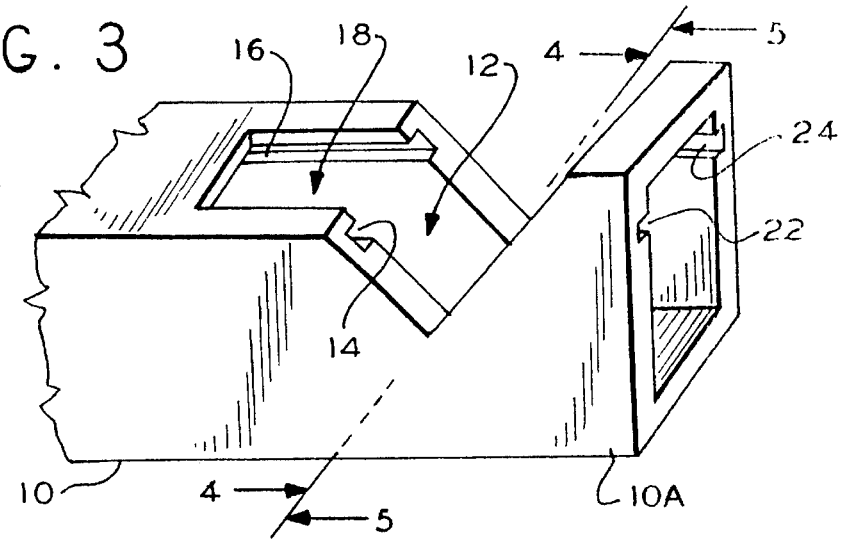
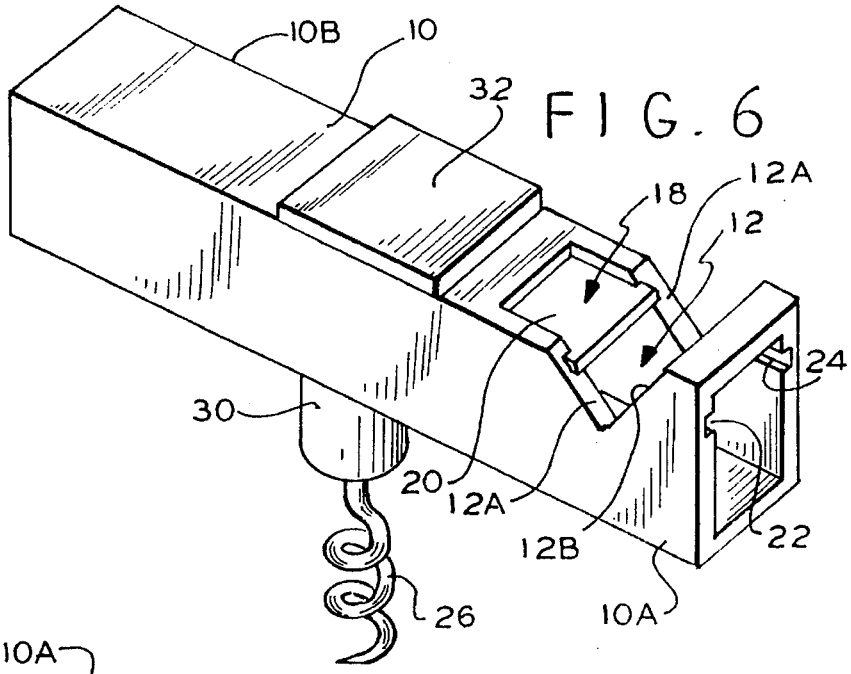
FIG. 6
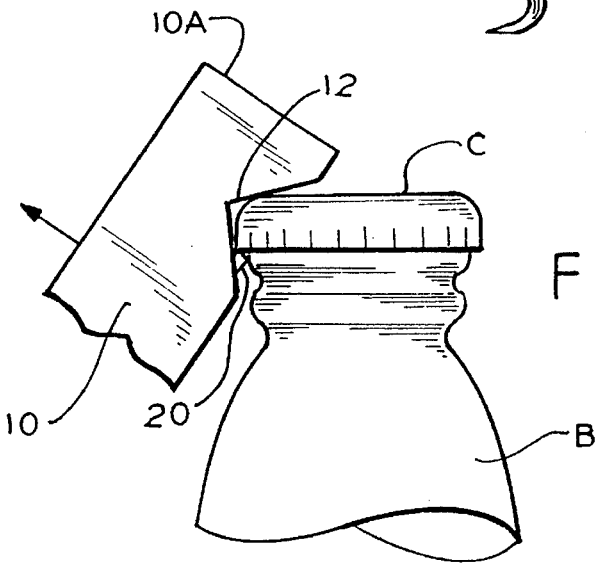
FIG. 7

OPENER FOR REMOVING A CONTAINER CAP

BACKGROUND OF THE INVENTION

1. Field of the Invention

The present invention relates to devices for removing caps from containers, and in particular, to openers having a handle with a notched end.

2. Description of Related Art

Numerous devices exist for opening bottles. Common openers include a metal stamping with one end formed into a cantilevered tab for hooking onto the edge of a bottle cap. A conventional corkscrew may have a helical screw on one end and a crossbar handle on the other end. See for example U.S. Pat. No. 71,316.

In U.S. Pat. No. 1,695,098 a bottle opener is in the form of an elongated shell having a hook at one end for grasping the underside of the bottle cap. This device also incorporates a corkscrew that is pivoted about a transverse axis near the center of the shell, to swing the corkscrew between an extended working position and a retracted stored position. This opener has a concave underside that would dig into a user's hand. Also, the hook is integral with the shell so that the shell unnecessarily has the same strength as the hook.

U.S. Pat. No. 1,218,757 shows a bottle opener having a corkscrew at one end, and a hook for removing a bottle cap on the other end. A tube that sheathes the corkscrew can be removed and inserted though a hole at the hooked end to serve as a handle for working the corkscrew. Forming a hole in the hooked end unnecessarily complicates and lengthens the hooked end. See also U.K. Patent Application GB 2091227 and U.S. Pat. No. 2,164,191.

For the corkscrew of U.S. Pat. No. 1,670,199, the conventional T-shaped structure was supplemented with an annular groove, so that the device can also be used to remove a conventional bottle cap. See U.S. Pat. No. 2,886,994 for another combined corkscrew and bottle cap remover. See also U.S. Pat. Nos. 2,714,409 and 5,285,543.

Another known bottle opener employed a metal tube notched at one end to provide a lip that can be used to remove a bottle cap. A disadvantage with this device is that the lip must be provided by an undercut and the entire device unnecessarily has the same strength as the lip. Also, the device is not easily fabricated.

Accordingly, there is a need for an improved opener that is relatively effective and employs an efficient structure.

SUMMARY OF THE INVENTION

In accordance with the illustrative embodiments demonstrating features and advantages of the present invention, there is provided an opener for removing a container cap. The opener has a handle with a first end, a second end, and between them a centrally located transverse bore. The first end has a notch extending transversely across the handle for engaging the container cap. The opener also has a helical device adapted to mount detachably and coaxially in the transverse bore of the handle.

In accordance with another aspect of the invention an opener can remove a container cap with a handle having a first and a second end. The first end has a notch extending transversely across the handle for engaging the container cap. This notch has a pair of banks. A discrete, rigid tab is mounted at one of the banks and extends partially into the notch for engaging the container cap.

By employing a structure of the foregoing type, an improved opener is achieved for removing a container cap. In the preferred embodiment, a V-shaped notch is made across one end of a rectangular tube. The notch intersects a parallel pair of longitudinal slots formed on opposite interior walls of the square tube. A rigid tab is mounted in the longitudinal slots on the proximal side of the notch to protrude slightly into the notch. Arranged in this fashion, the rigid tab can catch the rim of a container cap for prying open the container. In a practical embodiment, the longitudinal slots on one side of the notch align with grooves on the other side of the notch, so that the rigid tab can be installed by sliding the tab along the grooves, past the notch and into longitudinal slots.

The preferred embodiment employs a tubular handle, that can store an additional accessory. In one preferred embodiment, a corkscrew can be stored in the end of the tube that is opposite the notched end. This tubular handle also has a central transverse bore. Therefore, the corkscrew can be removed from the stored position and then inserted through the transverse bore to provide a T-shaped structure. Thus the handle forms a cross-bar for driving the corkscrew.

BRIEF DESCRIPTION OF THE DRAWING

The above brief description as well as other objects, features, and advantages of the present invention will be more fully appreciated by reference to the following detailed description of presently preferred, but nonetheless illustrative embodiments in accordance with the present invention, when taken in conjunction with the accompanying drawings, wherein:

FIG. 3 is a detailed, axonometric view of the notched end of the handle of FIG. 1, with the rigid tab removed;

FIG. 6 is an axonometric view of the opener of FIG. 1 with the helical device deployed in the transverse bore of the handle; and FIG. 7 is a detailed, side view of the opener of FIG. 1 being used to remove a cap on a container.

DETAILED DESCRIPTION OF PREFERRED EMBODIMENTS

Figure 1:
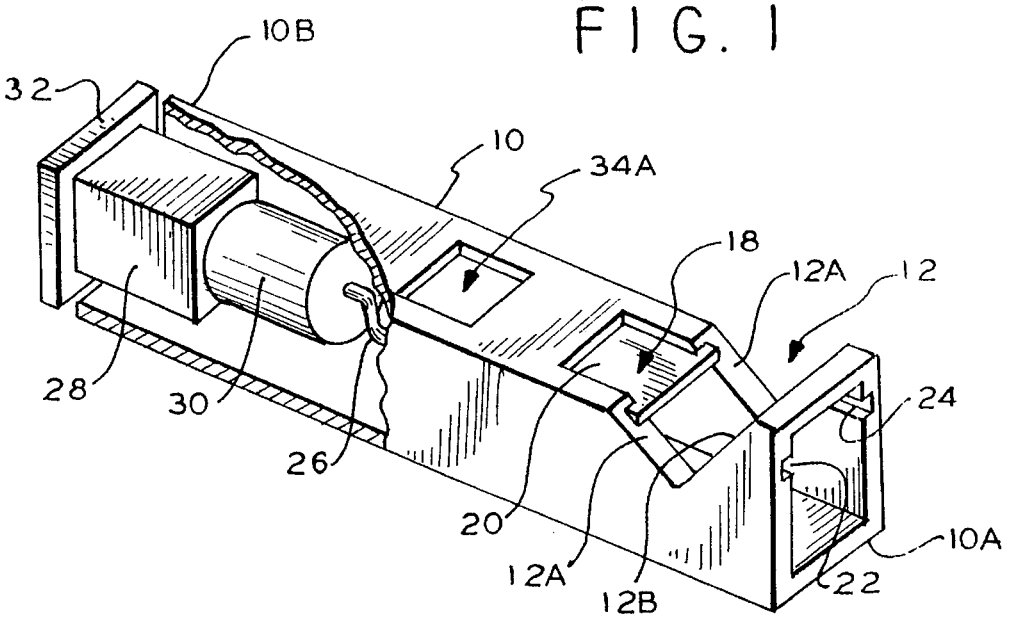
FIG. 1 is an axonometric view of an opener in accordance with the principles of the present invention.
Figure 4:
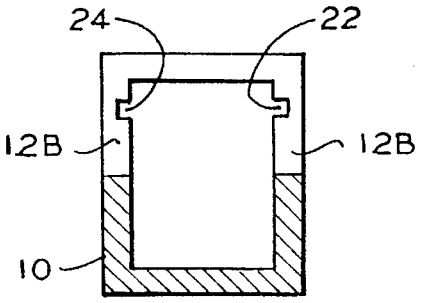
FIG. 4 is a cross-sectional view taken along line 4—4 of FIG. 3.
Figure 5:
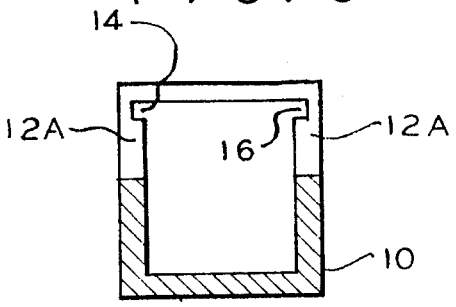
FIG. 5 is a cross-sectional view taken along line 5—5 of FIG. 3.
Figure 2:
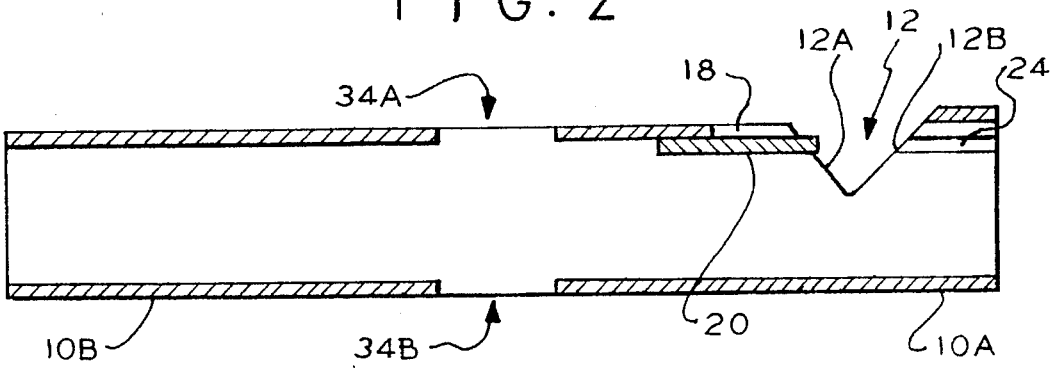
FIG. 2 is a longitudinal, sectional view of the opener of FIG. 1 with the corkscrew removed for simplification purposes.

Referring to FIGS. 1 and 2, an opener is shown as a handle 10 in the form of a rectangular tube. A first end 10A of handle 10 has a V-shaped notch 12. The notch 12 has pair of opposing banks, namely a proximal bank 12A and distal bank 12B. Since handle 10 has a hollow in the region of notch 12, each of these two banks are in the form of a pair of parallel edges. The distal bank 12B is higher since first end 10A is higher.

Preferably, the main body of handle 10 is a square tube having an outside dimension of 0.637 inch (1.62 cm) and a wall thickness of 0.094 inch (0.24 cm). First end 10A has the same width and wall thickness but has a greater height, namely, 0.712 inch (1.8 cm). The overall length of handle 10 is 4.07 inches (10.34 cm). It will be appreciated that all of the foregoing dimensions are exemplary, and that in other embodiments these dimensions can be altered depending upon the desired size, strength, structural rigidity, etc. Also, while a square or rectangular tube is illustrated, in some embodiments the tube perimeter may be polygonal, cylindrical, or some other shape. Furthermore in some embodiments, the handle need not be hollow or need only be partly hollow.

Referring to FIGS. 1–5, a pair of longitudinal slots 14 and 16 are formed in opposite interior walls of handle 10. Slots 14 and 16 run from the proximal bank 12A into the handle 10 a distance of 0.625 inch (1.6 cm), although other dimensions are contemplated. A span of the handle lying between slots 14 and 16 is removed to provide a window opening 18 along approximately 60 percent of the length of slots 14 and 16. Still, in some embodiments, window 18 may be of a different size or may be eliminated altogether.

FIG. 1 shows a tab 20 underneath window 18 and mounted in slots 14 and 16 (FIG. 3). Tab 20 is preferably a thin steel plate, about 0.03 inch (0.08 cm) thick, although other thicknesses are contemplated for other embodiments. Tab 20 is designed to fit in the slots 14 and 16 and extend into the notch 12 about 1 mm. Accordingly, tab 20 will be about 0.49 inch (1.24 cm) wide and 0.63 inch (1.6 cm) long. As explained further hereinafter, tab 20 is sized to project into notch 12 an amount sufficient to allow tab 20 to catch the underside of a container cap such as a bottle cap.

In other embodiments, tab 20 can be secured inside handle 10 in alternate fashions such as by glueing, riveting, by means of internal support brackets or by other means. Also, in some embodiments where the material of handle 10 is sufficiently strong, the tab may be replaced with an integral lip that is formed integrally with the handle (although use of a discrete tab is preferred to avoid the expense of making the entire handle as strong as the tab). In this preferred embodiment, handle 10 is formed of a molded plastic.

A pair of grooves 22 and 24 are formed on opposing interior walls at end 10A of handle 10. Grooves 22 and 24 align with longitudinal slots 14 and 16, respectively. Accordingly, tab 20 (FIG. 1) can be installed by sliding the tab along grooves 22 and 24 and then into slots 14 and 16. In other embodiments, the size of the opening in end 10A can simply be increased to provide clearance for the passage of tab 20. Alternatively, if notch 12 is sufficiently large or the tab 20 is sufficiently short, tab 20 can be inserted into longitudinal slots 14 and 16 by insertion directly through notch 12.

A helical device is shown herein as a corkscrew 26 attached to a shank having a square prismatic section 28 (also referred to as a matching polygonal or square prism), integrally connected to cylindrical section 30. Section 28 is capped by a square flange 32. Corkscrew 26 is preferably a pointed steel rod that has been coiled into a spiral having three turns; although a different number of turns may be used in alternate embodiments.

In FIG. 1, corkscrew 26 is shown sheathed inside handle 10. The outside dimensions of section 28 match the inside dimensions of handle 10 so that the device snugly fits inside the handle. Flange 32 prevents shank section 28 from slipping entirely inside handle 10, which would impede deployment. Shank sections 28 and 30 as well as flange 32 are integrally molded, with the corkscrew element 26 being embedded in the cylindrical shank section 30.

Handle 10 has a transverse bore in the form of a pair of opposing square holes 34A and 34B formed on opposing spans of the handle 10. Since holes 34A and 34B are aligned and appropriately sized, the square shank 28 fits in holes 34A and 34B without the ability to rotate. Thus corkscrew 26 can be removed from the position shown in FIG. 1 and installed transversely to handle 10 in the position shown in FIG. 6.

To facilitate an understanding of the principles associated with the foregoing apparatus, its operation will be briefly described. The opener may be assembled as shown in FIG. 1 with tab 20 in place and the cork-screw 26 sheathed inside handle 10 by being inserted through end 10B. In this condition, the device can be readily used to open a container B as shown in FIG. 7.

Container B may be a conventional bottle sealed with a bottle cap C. Notch 12 may be positioned as shown around the edge of cap C with the projecting tab 20 catching the rim of cap C. In this position, the handle 10 may be lifted, that is, rotated clockwise as indicated in FIG. 7. Accordingly, handle 10 is then a lever, which is used to pry open cap C to remove the cap from bottle B.

In embodiments employing corkscrew 26, the handle 10 can also open bottles sealed with a cork. For this purpose, corkscrew 26 is removed from end 10B of handle 10 and is inserted through the holes 34A and 34B (FIG. 2) to produce the T-shaped structure shown in FIG. 6. Accordingly, the user may grip the handle 10 and twist the corkscrew 26 in the usual fashion to thread it into a cork (not shown) of a bottle. Once the corkscrew 26 is thus embedded, the user may pull on the handle 10. Flange 32 keeps the corkscrew 26 secured to handle 10. Thus, the cork can be readily pulled from the bottle and the bottle can be uncorked. Thereafter, the cork can be removed from the corkscrew 26. Then the corkscrew can be removed from the transverse position illustrated in FIG. 6 and returned to the stored position shown in FIG. 1.

It is to be appreciated that various modifications may be implemented with respect to the above described preferred embodiments. In some embodiments, the corkscrew feature may be absent, in which case the transverse bore is unnecessary. In other embodiments the metal tab can be positioned differently and secured differently or in some instances eliminated and formed as an integral tab in the handle body. Moreover, the various dimensions of the handle, the corkscrew and other elements of the opener may be altered depending upon the expected size of the caps and containers, as well as on the desired size, strength and reliability of the opener. Furthermore, while a V-shaped notch is shown in one end of the handle, in other embodiments the notch may be rounded, undercut or exhibit another shape. While the handle body is preferably formed of molded plastic, in other embodiments metal, ceramic or other materials can be used instead. Also, in some embodiments the handle may be formed from interlocking or telescoping parts that are attached together by various means in order to simplify the molding or manufacturing of the handle.

Obviously, many modifications and variations of the present invention are possible in light of the above teachings. It is therefore to be understood that within the scope of the appended claims, the invention may be practiced otherwise than as specifically described.

We claim:

1. An opener for removing a container cap, comprising:

a hollow handle having a first end, a second end, and between them a centrally located transverse bore, said first end having a notch extending transversely across said handle for engaging said container cap; and a helical device adapted to mount detachably and coaxially in said transverse bore of said handle, said second end being open and sized to receive said helical device for storage inside said handle, said helical device including: (a) a corkscrew having an overall outside diameter sized to allow passage of said corkscrew through said transverse bore without screwing, and (b) a shank attached to said corkscrew and having a transverse dimension sized greater than said overall outside diameter of said corkscrew to stop passage of said helical device through said transverse bore.

2. An opener according to claim 1 wherein said handle is hollow and has peripherally, a square cross-section.

3. An opener according to claim 1 wherein said handle is hollow and has peripherally, a polygonal cross-section.

4. An opener according to claim 1 wherein said notch at said first end is V-shaped notch.

5. An opener according to claim 1 wherein said notch has a proximal bank and a higher distal bank.

6. An opener according to claim 1 wherein said transverse bore is polygonal and said shank comprises a matching polygonal prism.

7. An opener according to claim 6 wherein said transverse bore is square and said shank comprises a matching square prism capped with a flange.

8. An opener according to claim 1 wherein said notch has a pair of banks, said opener comprising:

a rigid tab mounted at one of said banks and extending partially into said notch for engaging said container cap.

9. An opener according to claim 8 wherein one of said banks has a longitudinal slot, said rigid tab being mounted in said longitudinal slot.

10. An opener according to claim 7 wherein said handle has a hollow, said first end opening into said hollow and said notch, said rigid tab being mounted at a proximal one of said banks of said notch, said first end having a pair of grooves extending to said notch to give clearance for installing said rigid tab through said first end into said longitudinal slot.

11. An opener for removing a container cap, comprising:

a handle having a first end and a second end, said first end having a notch extending transversely across said handle for engaging said container cap, said notch having a pair of banks; and a discrete, rigid tab mounted at one of said banks and extending partially into said notch for engaging said container cap, said handle having a tubular section intersected by said notch, said tubular section having a parallel pair of longitudinal slots intersecting one of said banks of said notch, said rigid tab being mounted in said longitudinal slots.

12. An opener according to claim 11 wherein said rigid tab is mounted in a proximal one of said banks of said notch.

13. An opener according to claim 12 wherein said notch at said first end is V-shaped.

14. An opener according to claim 12 wherein said notch has a proximal bank and a higher distal bank.

15. An opener according to claim 11 wherein said handle has a hollow intersected by said notch.

16. An opener according to claim 15 wherein said rigid tab is mounted at a proximal one of said banks, said first end opening into said hollow and said notch, said first end having a pair of grooves extending to said notch to give clearance for installing said rigid tab through said first end into said longitudinal slots.

17. An opener for removing a container cap, comprising:

a handle having a hollow, a first end, a second end, and a centrally located, polygonal, transverse bore between said first and said second ends, said first end having a V-shaped notch extending transversely across said handle for engaging said container cap, said notch having a proximal bank and a higher distal bank, said hollow having a parallel pair of longitudinal slots intersecting the proximal one of said banks of said notch, said first end opening into said hollow and said notch, said handle having peripherally, a polygonal cross-section; and a discrete, rigid tab mounted in said longitudinal slots at the proximal one of said banks and extending partially into said notch for engaging said container cap, said first end having a pair of grooves extending to said notch to give clearance for installing said rigid tab through said first end into said longitudinal slot; and a helical device adapted to mount detachably and coaxially in said transverse bore of said handle, said second end being open and sized to receive said helical device for storage inside said handle, said helical device having a shank and a corkscrew attached to said shank, said shank having a flange and a polygonal periphery matching said transverse bore.

* * * * *